United States Patent [19]

Stahlecker

[11] Patent Number: 4,522,023

[45] Date of Patent: Jun. 11, 1985

[54] OPEN END FRICTION SPINNING MACHINE

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, both of Fed. Rep. of Germany

[21] Appl. No.: 583,391

[22] Filed: Feb. 24, 1984

[30] Foreign Application Priority Data

Mar. 9, 1983 [DE] Fed. Rep. of Germany ..... 3308249

[51] Int. Cl.[3] ..... D01H 1/135; D01H 1/12; D01H 7/898

[52] U.S. Cl. ..... 57/401

[58] Field of Search ..... 57/400, 401, 408, 411, 57/352

[56] References Cited

U.S. PATENT DOCUMENTS

| | | | |
|---|---|---|---|
| 4,165,600 | 8/1979 | Schippers et al. | 57/401 |
| 4,315,398 | 2/1982 | Parker et al. | 57/401 |
| 4,367,623 | 1/1983 | Parker et al. | 57/401 X |
| 4,392,343 | 7/1983 | Parker et al. | 57/401 |
| 4,404,792 | 9/1983 | Parker et al. | 57/401 |
| 4,420,928 | 12/1983 | Fehrer | 57/401 |

*Primary Examiner*—Donald Watkins

*Attorney, Agent, or Firm*—Barnes & Thornburg

[57] ABSTRACT

An open end friction spinning device with two friction rollers driven in the same rotational direction and arranged adjacent one another to form a yarn producing wedge slot is disclosed. Single opened fibers are guided via a fiber feed channel subjected to a transport air stream. To facilitate and improve alignment of fibers in the wedge slot, a suction device for creating an auxiliary air flow in the draw-off direction of the yarn is provided in the area of the mouth of the fiber feed channel.

15 Claims, 11 Drawing Figures

OPEN END FRICTION SPINNING MACHINE

BACKGROUND AND SUMMARY OF THE INVENTION

The invention relates to an open end friction spinning machine with two rollers driven in the same rotational direction and arranged adjacent one another to form a yarn forming wedge slot. Individual fibers of opened fiber material are supplied to the wedge slot by means of a fiber feed channel, the fibers being twisted into a yarn in the wedge slot and being drawn off in the longitudinal direction of the wedge slot. The transport of individual fibers is effected by means of a transport air stream flowing in the fiber feed channel which opens with its mouth at the wedge slot or at the cover surface of a roller. The transport air stream is created by means of one or several suction devices arranged in an extension of the fiber feed channel.

In an open end friction spinning device of the above-mentioned kind, disclosed in German published application (DE-OS) 29 43 063, one of the two friction rollers is formed as a so-called suction roller which exhibits a perforated cover surface and within which a suction insert is arranged, the effects of which suction insert are limited to the region of the wedge slot. The second friction roller exhibits a cylindrical closed circumferential surface. In this construction it is provided that the feed channel opens in a channel end part which extends approximately over the entire length of the wedge slot in the axial direction and at which an auxiliary suction device is connected which creates an air stream in the direction against the yarn withdrawal direction. The transport air stream inside of the fiber feed channel is essentially created by means of the suction inserts in the suction roller. The auxiliary air stream should effect that the total air stream and at least a part of the fibers traveling therewith change their movement direction to movement against the yarn withdrawal direction so that the binding together of all fibers should be improved. This auxiliary air stream against the yarn withdrawal direction must be very carefully controlled because the danger exists that especially short and light fibers are sucked off and not twisted into the yarn. This auxiliary air stream leads also to irregularities in the yarn form because the danger exists that the incoming fibers are twisted or buckled by engagement at the cover surface of the roller or at the existing yarn and are then tied or bundled in the buckled form.

The invention is based upon the problem to improve the fiber deposition for the yarn formation and to decrease the risk of fiber losses, especially of short and light fibers.

These problems are thereby solved by the invention by providing a suction device connected at the fiber feed channel in the region of its opening, which suction device creates an auxiliary air stream in the withdrawal direction of the yarn.

With this auxiliary air stream it is achieved that the forward ends of the extended incoming fibers are somewhat already turned in toward the withdrawal direction before they arrive at the wedge slot or the cover surface of the yarn being formed. In this manner the fibers are aligned toward the withdrawal direction without the danger of a buckling or the like occuring. Furthermore, the light fibers are totally turned toward the withdrawal direction and already in the region of the fiber feed channel mouth are brought into connection with the existing yarn so that they are bound or tied therein and are not sucked out of the unit.

In advantageous arrangements of the invention there is provided a suction opening in one of the bordering walls of the fiber feed channel at the withdrawal direction of the yarn wall side, which suction opening is connected with an underpressure (vacuum pressure) source. This suction opening facilitates the desired alignment of the front ends of the fibers inside of the mouth of the fiber feed channel. It is practically additionally provided that the underpressure at the suction opening is adjustable by means of an adjusting member. Thereby one can also meter/control the auxiliary air stream and especially so that it is suitable for the particular fiber material being spun.

Further objects, features, and advantages of the present invention will become more apparent from the following description when taken with the accompanying drawings which show, for purposes of illustration only, several embodiments in accordance with the present invention.

BREIF DESCRIPTION OF THE DRAWINGS

DETAILED DESCRIPTION OF THE DRAWINGS

Figure 1:
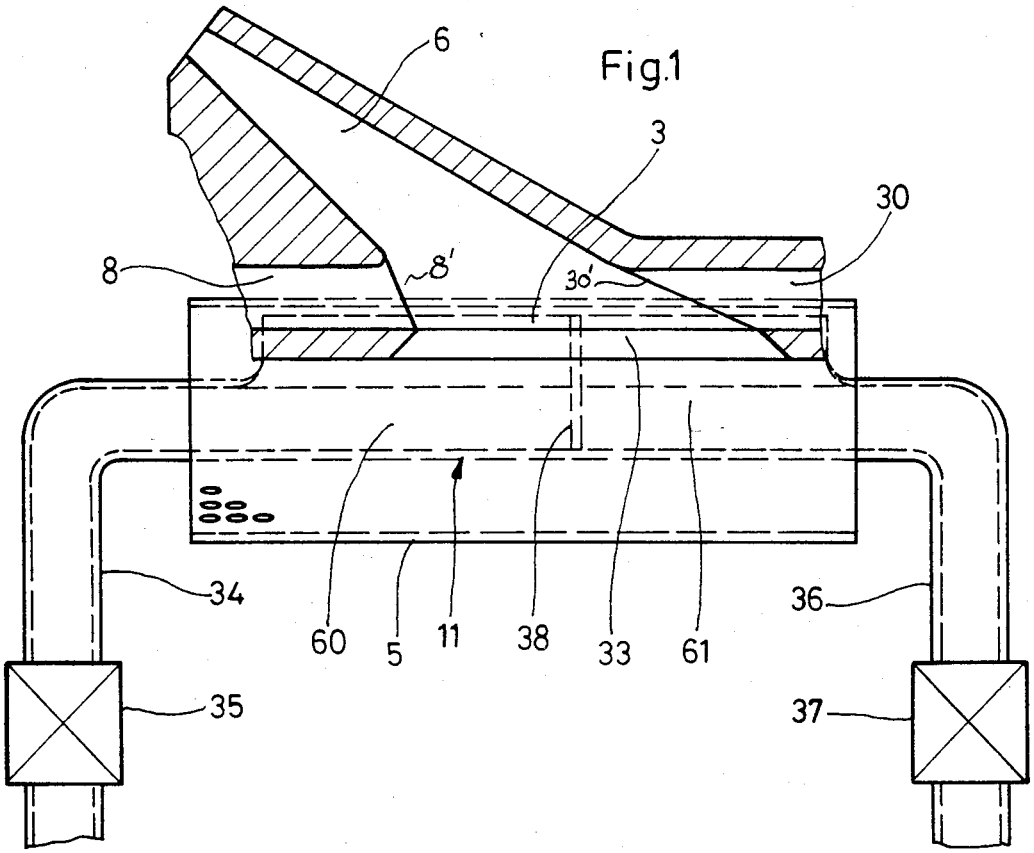
FIG. 1 shows a part sectional schematic view of an open end friction spinning device, with only one of the friction rollers shown for illustration purposes, constructed in accordance with a preferred embodiment of the invention.
Figure 2:
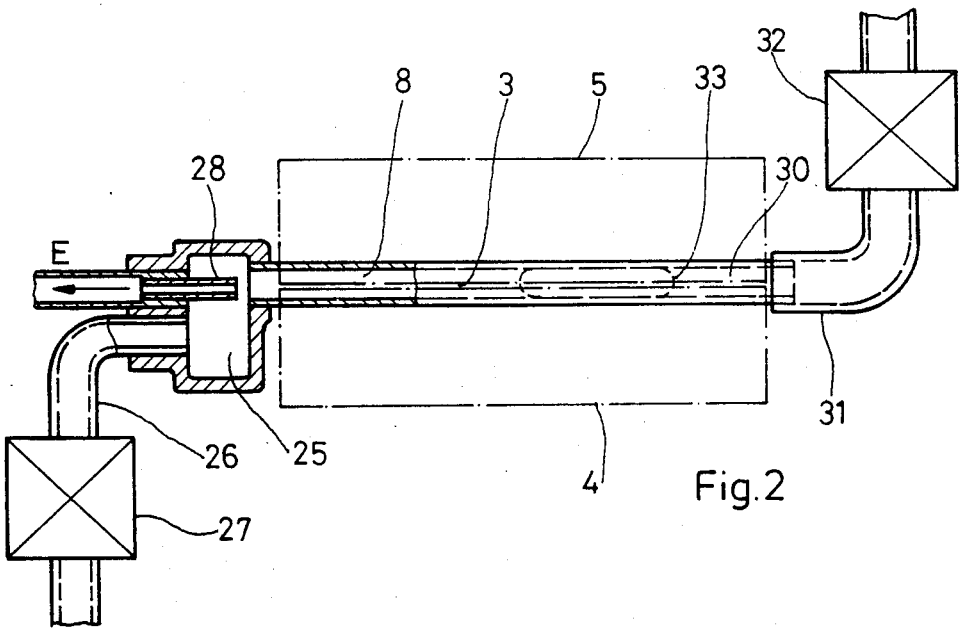
FIG. 2 is a schematic view in the direction of the yarn forming wedge slot of an open end friction spinning device constructed according to the FIG. 1 embodiment, in a smaller scale.
Figure 3:
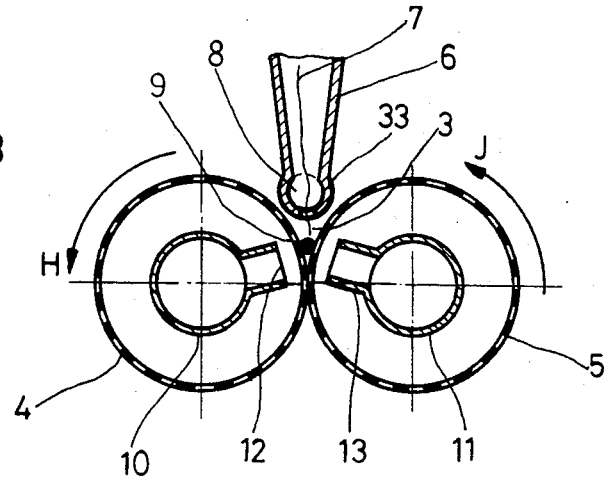
FIG. 3 is a cross-sectional schematic view of part of an open end friction spinning device according to FIGS. 1 and 2.

The open end friction spinning device illustrated in FIGS. 1–3 possesses two identically formed friction rollers 4 and 5 of the same size, which friction rollers are arranged closely adjacent to and parallel to one another to form a yarn forming wedge slot 3. The two rollers 4 and 5 are rotatably carried in a not further illustrated manner and are drivingly connected at a driving member to be driven in the same rotational direction (depicted by arrows J and H in FIG. 3).

Single fibers 7 of the opened fiber material are fed via a feed channel 6 to the wedge slot 3, which feed channel 6 is connected in a not further illustrated manner with a fiber feeding and opening device. The feeding and opening device can be generally similar to the known feeding and opening devices of the open end rotor spinning machines. The fed fibers are gathered in the wedge slot 3 and twisted into a yarn 9, which yarn 9 is drawn off longitudinally of the wedge slot 3 in the yarn withdrawal direction E (FIG. 2) by means of a not further illustrated withdrawal device. The withdrawal device includes a withdrawal roller pair followed by a winding device for winding the yarn at a spool.

The transport of the individual fibers 7 in the feed channel 6 is facilitated by means of an air stream which is essentially created in the embodiment of FIGS. 1–3 by means of two suction devices located on the inside of the rollers 4 and 5. On the inside of the rollers 4 and 5, suction inserts 10 and 11 are arranged. Slots 12 and 13 of the suction inserts 10 and 11 extend closely adjacent the inner surface of the rollers 4 and 5 and are disposed adjacent the region of the wedge slot 3.

At least one of the suction inserts 10 and 11 is divided into two segments or sections 60 and 61 by means of a radial separating wall 38, which sections are respectively connected by lines 34 and 36 to an under or vacuum pressure source. In the lines 34 and 36 there are arranged blocking and controlling valves 35 and 37, by means of which the underpressure in the segments 60 and 61 can be interrupted and also can be adjusted to a predetermined value.

The fiber feed channel 6 is disposed with an inclination of approximately 45° against the withdrawal direction E of the yarn, whereby channel 6 extends essentially in a plane through the wedge slot 3 and perpendicular to the common plane of the axles of the rollers 4 and 5. The fiber feed channel 6 widens continnuously in this plane until shortly before its mouth or opening 33. In the region shortly in front of the opening 33 there is arranged an auxiliary suction opening 8′ in the boundary wall of the fiber feed channel at the side of the withdrawal direction E. At this suction opening 8′ there is connected a channel 8 extending in the direction of the wedge slot 3 and opening into a chamber 25 in the region of the end faces of both rollers 4 and 5. The chamber 25 is connected by means of a line 26 to an underpressure source. A blocking and control valve 27 is arranged in line 26.

A yarn withdrawal tube 28 begins in the chamber 25, which tube is arranged as an extension of the wedge slot 3 of the two rollers 4 and 5 and through which tube the formed yarn is drawn off. For ease of illustration, FIG. 2 schematically depicts tube 28 and channel 8 in the same plane, however, actually the channel 8 extends at a distance with respect to the wedge slot 3. As also can be seen in FIG. 1, the opening 33 of the fiber feed channel 6 in the direction of the wedge slot 3 is actually wider than would be the case if there was a continual constant widening of the border walls of channel 6. With this construction it is achieved that the counter effects of the air stream are maximized.

In the boundary wall of the channel 6 at the side opposite of the withdrawal direction E of the yarn 9, there is provided a further suction opening 30′ which is also connected by means of channel 30 and a line 31 at an underpressure source. A closing valve 32 is arranged in the line 31.

Figure 4:
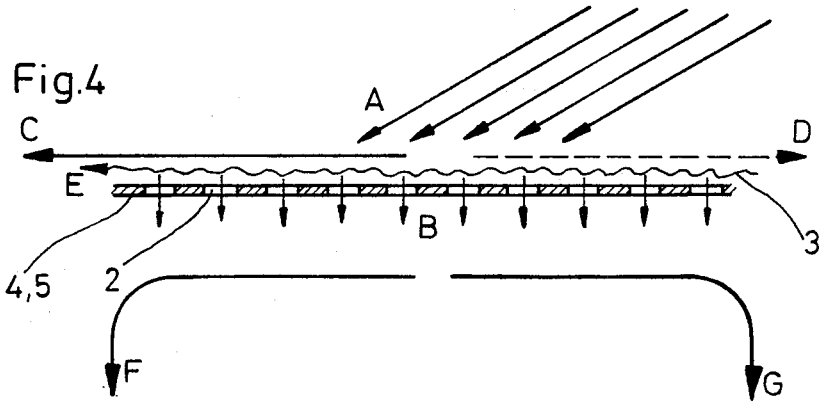
FIG. 4 is a schematic illustration of the air flow with an open end friction spinning device constructed according to a modificaton of the embodiment in FIGS. 1–3.

The controlled air stream flow resulting from the apparatus of the present invention is explained as follows, referring to FIG. 4. Here it should be noted that in contrast to the embodiment according to FIG. 1, the air stream A with which the single fibers 7 are transported in the fiber feed channel are aligned in the withdrawal direction E of the yarn with a component of approximately 45° (compare the slope of channel 6 of FIG. 1). The fiber transport air stream A is created essentially through the effect of the suction inserts 10 and 11 which create a radially directed air stream B in the bores 2 of the cover surfaces of the rollers 4 and 5. In order to prevent that the transport air stream A is prematurely turned in the radial direction of the air stream B which then would result in deflecting the forward ends of the flying fibers, there is an auxiliary air stream C created with the help of the suction opening 8′ in the mouth or opening region of the feed channel 6, which auxiliary air stream C flows in the direction of the withdrawal direction E of the yarn. With this air flow arrangement it is assured that the forward ends of the single fibers are not turned against the withdrawal direction and buckled or crumpled, which would lead to a non-linear line deposition of fibers. A similar effect is achieved according to preferred embodiments of the invention if the single fibers are guided in the feed channel with an air stream velocity component against the withdrawal direction E (compare FIG. 1), because then through the auxiliary air stream C the forward ends of the fibers in any event are turned toward the yarn withdrawal direction E so that they are not upset and buckled during the fiber depositing.

Through the use of separating wall 38 (FIG. 1) in one or both of the suction inserts and the thereby resultant separation of the suction inserts 10 and 11 into segments or sections 60 and 61 which are respectively communicated with underpressure, it can furthermore be provided that the strength of the radial airstream is varied over the length of the wedge slot 3, especially also in the region of the mouth 33 of the fiber feed channel 6. In order to facilitate the desired effect of the alignment of the in-flying fibers with their forward ends extending in the withdrawal direction E of the yarn, the section 61 disposed furthest away from the withdrawal direction E can be provided with a smaller underpressure. Both sections 60 and 61 can be connected over the corresponding lines 34 and 36 at their respective own underpressure sources (vacuum pump or the like) which exhibit respective different underpressures. It is however, also contemplated in certain preferred embodiments to connect both segments 60 and 61 at the same underpressure source and then adjust the underpressure in the segments 60 and 61 by means of the control valves 35 and 37. Also, the underpressure creating the auxiliary air stream C can be adjusted to a pre-determined value, for which purpose the control valve 27 arranged in the underpressure line 26 is provided. It is also contemplated in certain embodiments to connect this underpressure line 26 at the same underpressure source as for suction inserts 10, 11.

In order to start spin after a yarn break, an end of the already formed yarn must be guided back to the wedge slot to a position at least in the region of the mouth 33 of the fiber feed channel 6, whereafter a start spinning operation can be carried out. The suction opening 30′ with the channel 30 and the suction line 31 is provided primarily in order to facilitate this return guidance of yarn end for start spinning operations.

During the return guidance of the yarn end for start spinning the valves 35 and 37 are suitably closed so that no underpressure exists in the suction inserts 10 and 11. To begin the return guidance on the other hand, the valve 27 is opened so that the yarn end is sucked back into the region of the chamber 25. Thereafter that valve 27 is closed so that then the yarn end is sucked to the suction opening 30' of the channel 30. Thereafter the remaining valves can be again opened while the valve 32 is closed. The yarn end then is located in its start spinning ready position.

Figure 5:
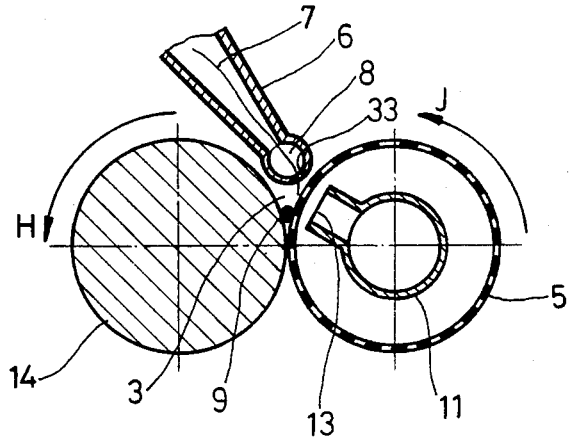
FIG. 5 is a cross-sectional partial view of an open end friction spinning device constructed according to a second embodiment of the present invention.

In the embodiment of FIG. 5 it is provided that only one of the friction rollers, namely the roller 5 turning inwardly toward the fiber feed side of the wedge slot 3, is provided as a suction roller. The second roller 14 possesses a closed cylindrical cover surface which in any event can be provided with a coating. The fiber feed channel 6 is so configured in this embodiment that its mouth 33 in the region of the wedge slot 3 is aligned to the coating surface of the roller 5 formed as the suction roller so that the fibers are fed to the surface of this roller 5.

Figure 6:
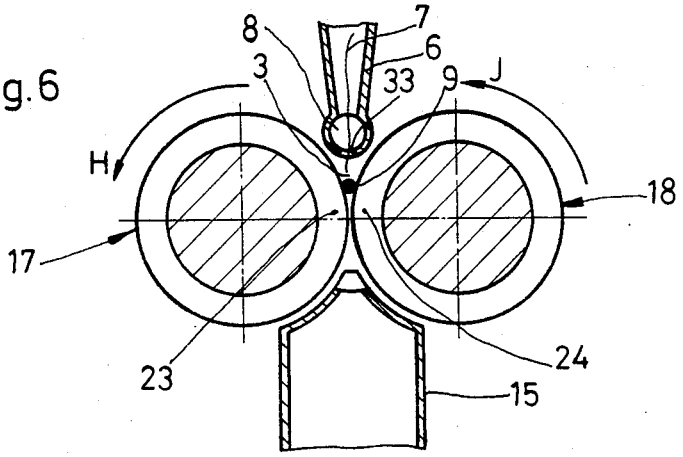
FIG. 6 is a cross-sectional partial view of an open end friction spinning device constructed according to a third embodiment of the present invention.
Figure 7:
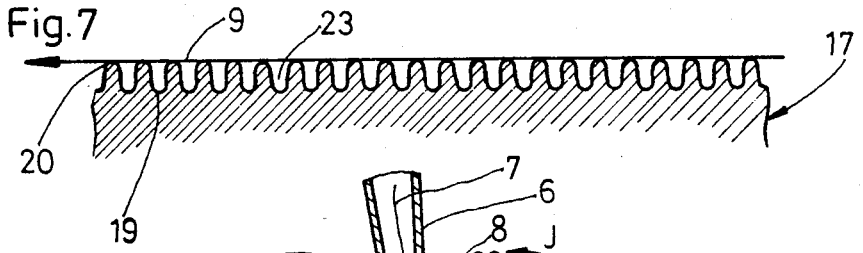
FIG. 7 is a partial sectional view taken in the axial direction through one of the friction rollers in FIG. 6.

In the embodiments according to FIGS. 6 and 7 two friction rollers 17 and 18 are arranged parallel to one another and exhibit closed cover surfaces. The two rollers 17 and 18 are provided with ring grooves 23 and 24 (see also FIG. 7) which form through air flow openings in the region of the wedge slot 3 through which air streams laterally around and past the formed yarn 9 to a suction nozzle 15, which suction nozzle 15 is arranged at the side of the wedge slot 3 oppositely of the fiber feed channel 6. The suction nozzle 15, which is formed as a slot nozzle extending in the axial direction over the length of the wedge slot 3, creates the transport air stream in the fiber feed channel 6, with which the individual fibers are transported up to the opening 33 and from there into the wedge slot 3. Also in this embodiment a channel 8 is connected in the region of the mouth 33 with a suction opening at the fiber feed channel 6, which channel 8 and suction opening create an auxiliary air stream in the yarn withdrawal direction E in the region of the suction opening 33. The effect of this auxiliary air stream can be amplified by dividing the suction nozzle 15 in the region of the wedge slot 3 into section in which differently strong suction drafts are created. This division results in a practical air flow in the region of the mouth 33 of fiber feed channel 6, corresponding generally to the air flow of the embodiments of FIGS. 1–4.

Figure 8:
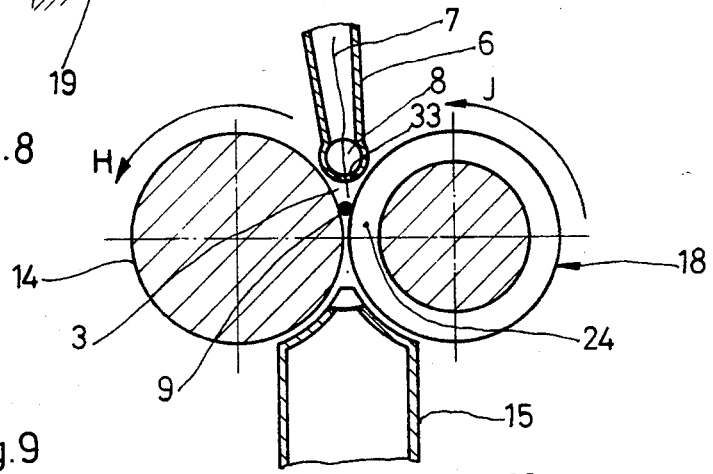
FIG. 8 is a cross-sectional partial view of an open end friction spinning device constructed according to a fourth embodiment of the present invention.

In the embodiment according to FIG. 8, a closed cylindrical coated surface friction roller 14 operates together with a friction roller 18 provided with ring grooves 24 at its cover surface. Also in this embodiment the transport air stream is created by means of a suction nozzle 15 disposed at the side of the wedge slot 3 oppositely of the fiber feed channel 6. In this case the mouth 33 of the fiber feed channel 6 is arranged in the region of the wedge slot 3 aligned with the cover surface of the roller 18.

Figure 9:
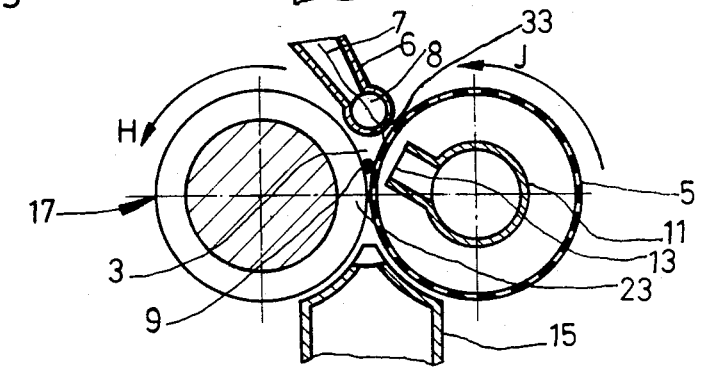
FIG. 9 is a cross-sectional partial view of an open end friction spinning device constructed according to a fifth embodiment of the present invention.

In the embodiment of FIG. 9 two friction rollers operate together as suction rollers with one formed as a suction roller 5 and the other roller 17 with ring grooves 23 at a profile cover surface. In addition to the suction insert 11 on the inside of the roller 5 there is a suction slot shaped nozzle 15 arranged at the side of the wedge slot 3 opposite the fiber feed channel so that the transport air stream is created in the feed channel 6 due to effects from the suction insert 11 and from the suction nozzle 15. In this embodiment the fiber feed channel 6 is so arranged that its mouth 33 is disposed oppositely of the cover surface of the roller 5 at a distance from the wedge slot 3 so that the feeding is not directly in the wedge slot 3, rather by means of the cover surface of roller 5. It is however also contemplated in a modification of this embodiment to so configure the feed channel 6 that the feeding of the individual fibers 7 results directly into the wedge slot 3. When the fiber feeding is onto the cover surface of the roller it is always practical to have the fibers impinge against the coating surface of the roller which turns into the wedge slot 3, which in FIG. 9 is the roller 5 formed as a suction roller.

Figure 10:
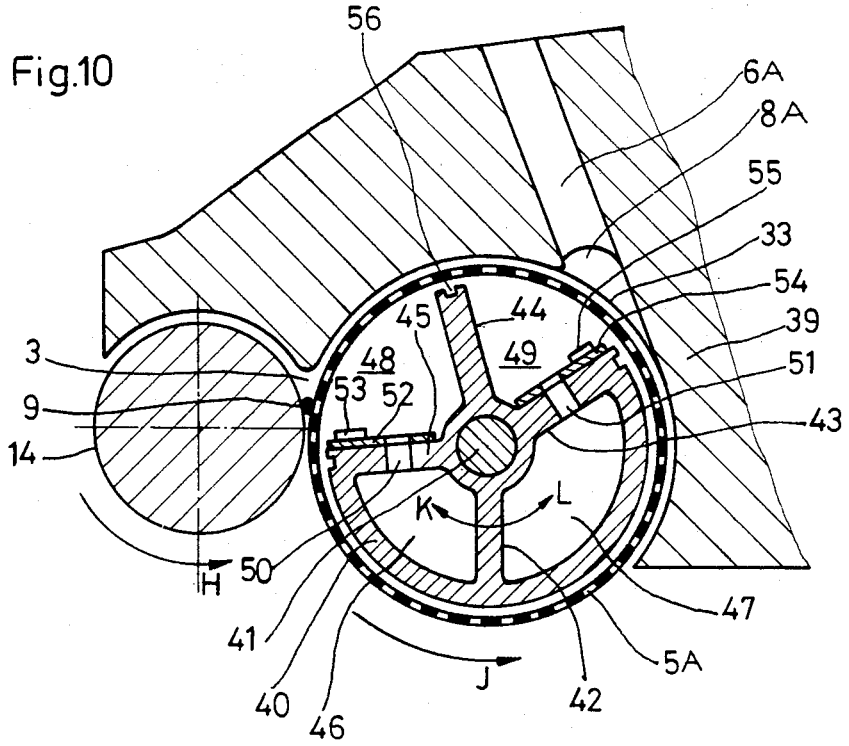
FIG. 10 is a cross-sectional partial view of an open end friction spinning device constructed according to a sixth embodiment of the present invention.
Figure 11:
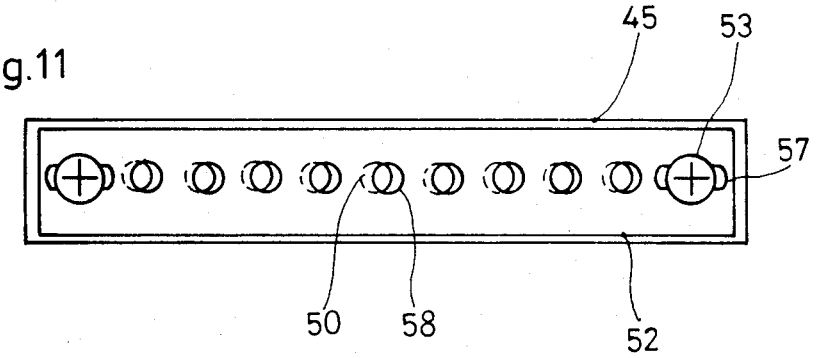
FIG. 11 is a view of a detail of the FIG. 10 embodiment.

As in the embodiment of FIG. 5, in the embodiment of FIG. 10 the roller 5A turning in the direction toward the wedge slot 3 is formed as a suction roller while the roller 14 turning outwardly of the wedge slot is formed with a closed cylindrical cover surface. In this embodiment the fiber feed from fiber feed channel 6 is via mouth 33 opening at a relatively large distance from the wedge slot 3 onto the cover surface of the suction roller 5A adjacent where it is connected with a sucton opening and a channel 8A to a low or underpressure source. The fiber feed channel 6A is located in a housing part 39 which partly surrounds a large area of the cover surfaces of the rollers 14 and 5 with conforming shell shaped recesses or receptacles. The single fibers 7 entering from the mouth 33 are turned by the roller 5A and transported to the wedge slot 3 in which they are together twisted to form a yarn and are drawn off in the longitudinal direction of the wedge slot 3.

The roller 5A includes a suction insert 40 by means of which on the one hand a transport air stream is created in the fiber feed channel 6 and on the other hand an air stream is created in the region of the wedge slot 3. The suction insert 40 is divided in the circumferential direction into two chambers 48 and 49 which are separated from one another by a dividing wall 44. The underpressure in the chamber 49 creates the transport air stream in the fiber feed channel 6 while the underpressure in the chamber 48 serves to hold the fibers at the cover surface of the roller 5A and later in the region of the wedge slot 3. In order here to create a sufficient air stream which is independent of the transport air stream the housing part 39 is provided in a not further illustrated manner with bores leading to the atmosphere. The separating wall 44 extends to closely adjacent the inner wall of the roller 5A. In order to hold a sealing means, the radially outer surface of the separating wall 44 facing the inner wall of the roller 5A is provided with a type of labyrinth seal formed profiling 56. In both segments or chambers 48 and 49 there is created different vacuum pressures. For this purpose the suction insert is divided in the circumferential direction by means of separating walls 42, 43 and 45, into two further chambers 46 and 47, which chambers are respectively connected at an underpressure source, for example by means of control devices at a common underpressure source. The separating walls between the chambers 46 and 47 and the corresponding chambers 48 and 49 are provided with cross bores 50 and 51. Covering sheets 52 and 54 fastened by means of screws 53 and 55 are provided at the walls 43, 45, which covering sheets are provided with a row of openings 58 corresponding to the bores 50, 51. Axial sliding movement of the sheets 52 and 54 in the slot guides 57 effects adjustment of the cross-sectional size of the bores 50 and 51.

The suction insert 40 is rotatable in the direction of the arrows K and L and fixedly held in these positions so that the disposition of the chambers 48 and 49 with respect to the wedge slot and the feed channel 6 can be adjusted. This also permits the changing of the effective vacuum pressure at the yarn 9, which leads to a change in the volume of the yarn 9 as well as a change in the effective vacuum pressure at the fiber feed channel 6.

It should also be noted that the axial extension of the chambers 49 is limited only to the region of the mouth 33 of the fiber feed channel, which corresponds to the embodiment of FIG. 1. The chamber 48 extends on the other hand over substantially the entire length of the wedge slot 3.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open end friction spinning comprising:

two friction rollers arranged adjacent to one another to form a yarn forming wedge slot therebetween, yarn withdrawing means for guiding the withdrawal of yarn from the wedge slot, fiber feed channel means for guiding fibers to the region of the friction rollers, transport air stream inducing means for inducing a flow of transport air to aid in the transport of the fibers in the fiber feed channel means, and auxiliary air stream inducing means for inducing a flow of auxiliary fiber transport air flowing in the yarn withdrawal direction in the region of the outlet opening of the fiber feed channel means, whereby alignment of fibers to be spun into yarn in the wedge slot is enhanced.

2. Apparatus according to claim 1, wherein said auxiliary air stream inducing means includes an auxiliary suction opening which opens to the fiber feed channel at the fiber outlet opening thereof.

3. Apparatus according to claim 2, wherein said auxiliary suction opening is connected to a vacuum pressure source, and wherein the suction opening is located in a boundary wall at the fiber feed channel means on the side of the yarn draw off direction.

4. Apparatus according to claim 3, further comprising adjusting means for adjusting the vacuum pressure at the suction opening.

5. Apparatus according to claim 2, wherein an auxiliary suction channel is connected at the suction opening, wherein said yarn withdrawal means includes a yarn withdrawal tube arranged in a withdrawal chamber formed at an extension of the wedge slot, wherein the auxiliary suction channel communicates with the withdrawal chamber, and wherein suction means are communicated with the withdrawal chamber to apply vacuum pressure thereto.

6. Apparatus according to claim 2, wherein at least one of the friction rollers exhibits a perforated cover surface and a suction insert means arranged on the inside thereof in the region of the wedge slot, said transport air stream inducing means including said suction insert means.

7. Apparatus according to claim 6, wherein the suction insert means is divided into a plurality of sections by means of at least one separating wall, and wherein different pressures are created in each section.

8. Apparatus according to claim 7, wherein the sections are connected with one another by means of openings with adjustable cross-sections.

9. Apparatus according to claim 7, wherein the sections are connected at a vacuum pressure source.

10. Apparatus according to claim 6, wherein pressure control blocking members are arranged in vacuum connection lines of the suction insert means.

11. Apparatus according to claim 6, wherein the suction insert means of at least one of the friction rollers is divided in the axial direction into sections under different vacuum pressures.

12. Apparatus according to claim 7, wherein the suction insert means of at least one of the rollers is divided in the circumferential direction into sections at different pressures.

13. Apparatus according to claim 2, wherein at least one of the friction rollers exhibits a closed cover surface which is provided with a profiling which forms air through flow openings to a suction nozzle arranged at the opposite side of the wedge slot from the fiber feed channel means.

14. Apparatus according to claim 13, wherein the suction nozzle (15) is divided in the direction of the wedge slot into sections with different suction effects.

15. Apparatus according to claim 2, wherein a further suction opening is provided in the wall bordering the fiber feed channel means opposite the withdrawal direction of the yarn, which further suction opening is connected under interposition of a selectively actuable blocking member at a vacuum pressure source, said further suction opening being disposed in the region of the fiber outlet of the fiber feed channel means and serving for the application of suction pressure to return a yarn end for start spinning operations.

* * * * *